US006675937B2

(12) United States Patent
De Leeuw et al.

(10) Patent No.: US 6,675,937 B2
(45) Date of Patent: Jan. 13, 2004

(54) FORK-LIFT TRUCK

(75) Inventors: Marc De Leeuw, Stiens (NL); Sierd Harkema, Twijzelerheide (NL); Gerrit Reitsma, Surhuisterveen (NL)

(73) Assignee: Kooi B.V. (NL)

( * ) Notice: Subject to any disclaimer, the term of this patent is extended or adjusted under 35 U.S.C. 154(b) by 37 days.

(21) Appl. No.: 09/957,301

(22) Filed: Sep. 20, 2001

(65) Prior Publication Data

US 2002/0100643 A1 Aug. 1, 2002

(30) Foreign Application Priority Data

Sep. 22, 2000 (NL) ..... 1016279

(51) Int. Cl.[7] ..... B66F 9/06

(52) U.S. Cl. ..... 187/222; 187/228; 187/414; 180/425; 414/631

(58) Field of Search ..... 187/222, 228, 187/232, 414, 240, 244; 180/400, 408, 411, 425; 414/631, 655, 661

(56) References Cited

U.S. PATENT DOCUMENTS 1,768,149 A * 6/1930 Remde ..... 414/655
2,880,897 A * 4/1959 Wilms et al.
3,556,241 A * 1/1971 Mitchell et al. ..... 180/411
3,610,453 A * 10/1971 Goodacre ..... 414/631
4,413,708 A * 11/1983 Stedman ..... 187/222
5,325,935 A * 7/1994 Hirooka et al. ..... 180/411

FOREIGN PATENT DOCUMENTS

GB 899439 A * 6/1962
JP 2000281298 A * 10/2000 ..... B66F/9/24
WO WO 8103482 A * 12/1981 ..... B66F/9/06

* cited by examiner

*Primary Examiner*—Eileen D. Lillis
*Assistant Examiner*—Thuy V. Tran
(74) *Attorney, Agent, or Firm*—Mark Zovko

(57) ABSTRACT

A fork-lift truck for selectively displacing a load forward or sideways, comprising a horizontal, substantially U-shaped frame, a lifting mechanism for carrying the load, wherein legs of the frame extend along the lifting mechanism, and wheels on the legs which are connected to the legs via rotating mechanisms for driving and are rotatable on a substantially upward axis between positions corresponding with sideways and forward movements of the fork-lift truck. Flexible power supply and control lines run with slack through the legs to the wheels. There is further provided a bending mechanism at each of the legs for bending the power supply and control lines without frictional contact with the interior of the legs during release of the slack.

7 Claims, 3 Drawing Sheets

16
9
4
15
21
18
19
17
22
20

16
9
23
21
18
19
20
22
15
4
16
23
9
21
15
4
18
19
22

23

19
21
16
18
22
15
4
9
23
19
21
18
15
22
9
4
16

FORK-LIFT TRUCK

The present invention relates to a fork-lift truck for selectively displacing a load forward or sideways, comprising: a horizontal, substantially U-shaped frame; a lifting mechanism for carrying the load, wherein legs of the frame extend along the lifting mechanism; and wheels on the legs which are connected to the legs via rotating mechanisms for driving and which are rotatable on a substantially upward axis between positions corresponding with sideways and forward movements of the fork-lift truck, wherein flexible power supply and control lines run with slack through the legs to the wheels.

Such fork-lift trucks are generally known, wherein the power supply and control lines are connected to for instance drive motors for the wheels, the rotating mechanism, a support foot for energizing with a cylinder etc. Flexible lines are preferred in view of the high cost in respect of both work and material and other factors. The slack in the power supply and control lines is essential during rotation of the rotating mechanism to maintain the connection to the motor and/or the rotating mechanism etc. at each angular displacement of the rotating mechanism. In any angular position hereof corresponding with substantially forward and/or sideways movement the wheels can herein be driven, varied in position and so on.

The known fork-lift trucks have a number of drawbacks. These power supply and control lines are normally laid loosely through the legs of the frame. When released, the necessary slack in the power supply and control lines is herein taken up in sliding manner in the interior of the legs. Release of the slack is understood to mean that the wheels are placed in a position wherein, in the case of an angular displacement of the position of the wheels wherein a greater length of the power supply and control lines is necessary to maintain the connection, the slack becomes available to provide the extra length herefor.

The sliding take-up of the slack in the legs results in wear of the power supply and control lines. In the known fork-lift trucks the lines have to be replaced frequently or covered with wear-resistant material, which not only has an adverse effect on the flexibility of the lines but also on production costs. Sufficient internal space is further necessary in the legs of the frame to provide room for the slack of the power supply and control lines. It is hereby necessary in the known fork-lift trucks to use very thick legs for the frame, and this involves high costs. The use of legs with sufficient internal space to take up the slack therein further results in limitations in respect of the tyre sizes which can be used, in particular the widths hereof. The greatest possible distance between the legs is desired to enable placing therebetween of the widest possible lifting mechanism, for instance a fork mechanism. Maximum widths of fork-lift trucks are usually regulated by law. For determined fields of application, for instance in the use of the fork-lift truck on sand, associated tyre sizes, in particular widths, are required. The need for a large internal space in the legs therefore reduces the space available between the legs and/or the width of the fork-lift truck and/or the possible width of the tyres. All available internal space is further required to take up the slack, so that there is no room in the legs or extensions thereof for a rotating mechanism designed for instance as hydraulic cylinder. This must therefore be mounted outside the internal space, i.e. on or adjacently of or under the legs, which is unfavourable due to the vulnerability thereof and also in applications wherein the fork-lift truck is suspended on the rear of a truck. In this latter use, space available in the truck is lost due to the cylinder for suspending the fork-lift truck, or the free space under a fork-lift truck suspended from the truck becomes small.

The present invention has for its object to obviate or at least reduce the above stated and other problems of the known fork-lift truck, for which purpose the fork-lift truck according to the present invention is distinguished from the known fork-lift trucks in that it further comprises: a bending mechanism at each of the legs for bending the power supply and control lines without frictional contact with the interior of the legs during release of the slack. Wear of the power supply and control lines is avoided according to the invention and it is possible to suffice with a small internal dimension of the legs of the frame, with the result of thinner legs and more space available for the greatest possible distance between the legs and/or a tyre size, in particular the width thereof, depending on the field of application. A rotating mechanism can also be accommodated in the legs or extensions thereof.

Many embodiments of the bending mechanism are possible within the scope of the invention. A number of possibilities are defined in the sub-claims. The bending mechanism can for instance comprise at least one clamp connected to the rotating mechanism. The clamp defines the bending shape into which an associated flexible power supply and control line is placed when the slack is released. This is an advantageous embodiment which is readily realized. When moving in the direction of the leg the curve for instance approaches the direction parallel to a tangent of a turning circle of the rotating mechanism.

Additionally or alternatively, the bending mechanism can comprise at least one guide connected to the leg. During rotation of the rotating mechanism the associated flexible power supply and control line can be carried into a curvature which, when moving in the direction of the leg, approaches a direction parallel to a tangent on a turning circle of the rotating mechanism, although other forms of the bending curve are possible.

The invention will be further elucidated hereinbelow with reference to the annexed drawings in which an embodiment of the fork-lift truck according to the present invention is shown, and in which.

Figure 1:
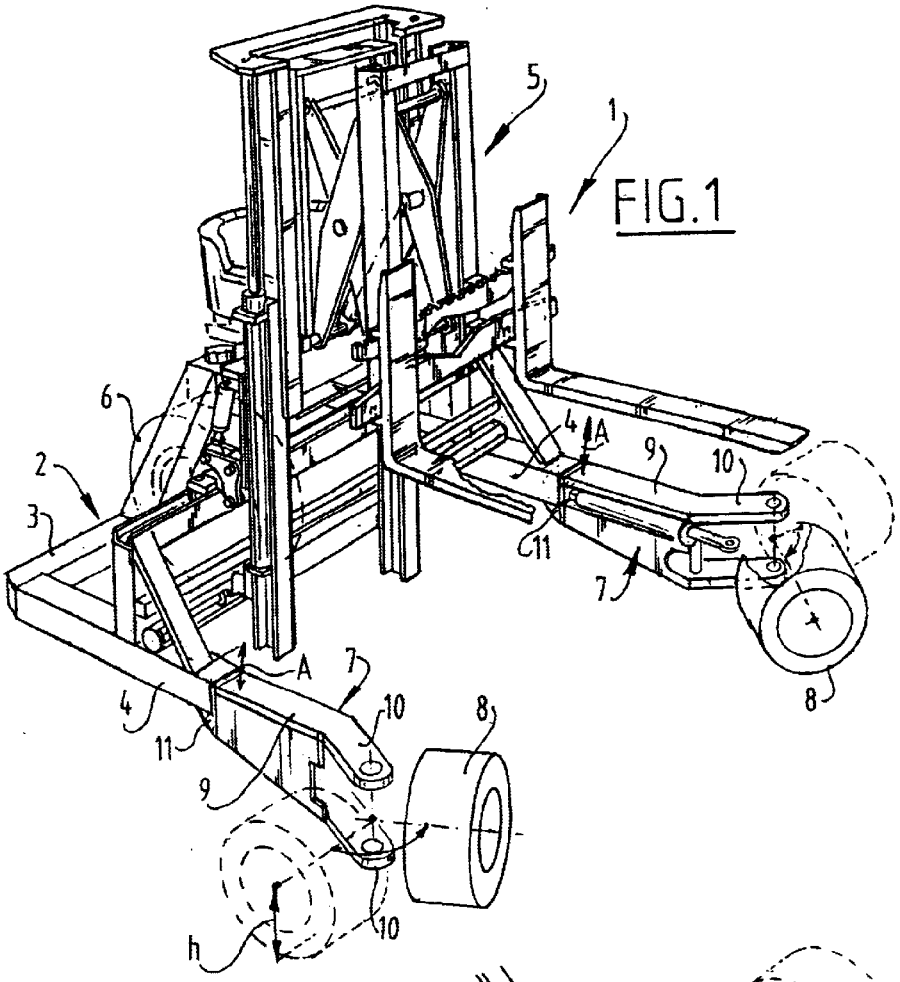
FIG. 1 shows a perspective view of a fork-lift truck according to the present invention.

FIG. 1 shows a fork-lift truck 1 according to the present invention. Fork-lift truck 1 comprises a frame 2 comprising a body 3 and two legs 4. Legs 4 extend along a lifting mechanism 5 for carrying a load during displacement thereof.

Arranged on body 3 of frame 2 is a wheel 6 which is normally used to steer fork-lift truck 3. Further wheels 8 are arranged on legs 4 via wheel suspensions 7. In the embodiment shown here the wheel suspensions 7 each comprise a fork 9. Each of the forks 9 comprises two arms 10 between which a wheel block is placed for mounting of a wheel. Each wheel block comprises a rotating mechanism as further described hereinbelow. A wheel suspension designed as fork 9 is therefore favourable in that a solid base is hereby provided for the wheel block, which is not shown in FIGS. 1 and 2 but which is shown FIG. 3.

Figure 2:
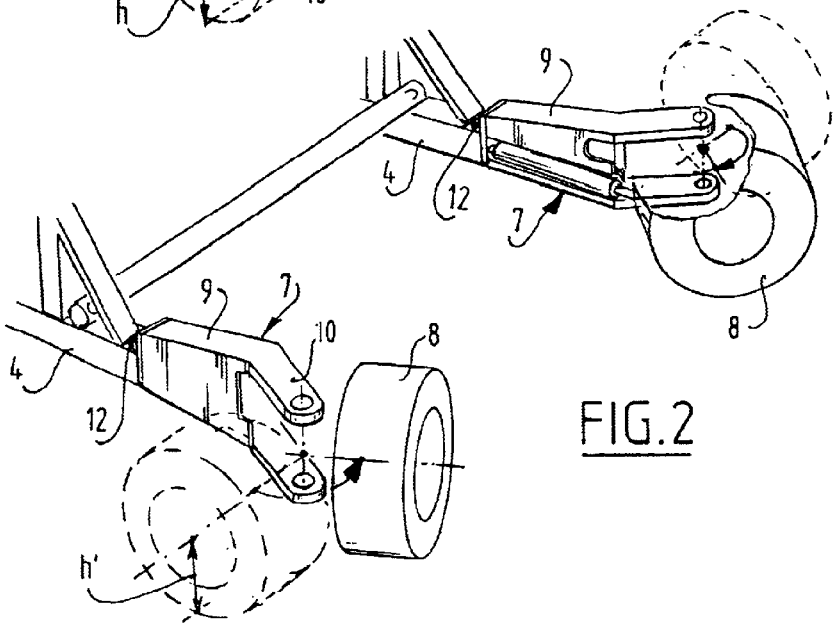
FIG. 2 shows a part of the fork-lift truck depicted in FIG. 1.

A comparison of FIG. 1 and FIG. 2 shows clearly that forks 9 in FIG. 2 are reversed relative to FIG. 1, i.e. forks 9 are rotated through a half-turn along the longitudinal direction thereof and of the legs 4 of frame 2 and each are arranged on another of the legs 4. In FIG. 1 the height h of the rotation axis of wheels 8 is lower than the height h' in FIG. 2, which is realized by turning over the forks 9. Without tilting of fork-lift truck 1 larger wheels 8 can thus be used in the configuration of FIG. 2 than in the configuration of FIG. 1 by varying the position of forks 9 relative to legs 4 of frame 2.

Variation in a greater range is also possible without interchanging of the forks 9 on legs 4 in that forks 9 have in vertical direction of fork-lift truck 1 a contact surface directed toward the legs 4 of frame 2 that is larger than the outer end of legs 4. Forks 9 can therefore be mounted variably on legs 4 in the direction of double arrow A in FIG. 1. This provides still further refinement in the choice of the number of applicable wheel diameters than merely reversing the forks 9 as shown in FIG. 2 relative to FIG. 1. This is also clearly shown in FIG. 3, which shows more clearly that the mounting surface 11 of fork 9 is larger in vertical direction of fork-lift truck 1 than the height of leg 4. Fork 9 can thus be arranged variably on leg 4 in the direction of double arrow A, wherein a larger wheel size of wheel 8 can be applied without thereby causing tilting of the fork-lift truck or having to use an extremely large wheel 6 on the body of the U-shape of frame 2.

Figure 3:
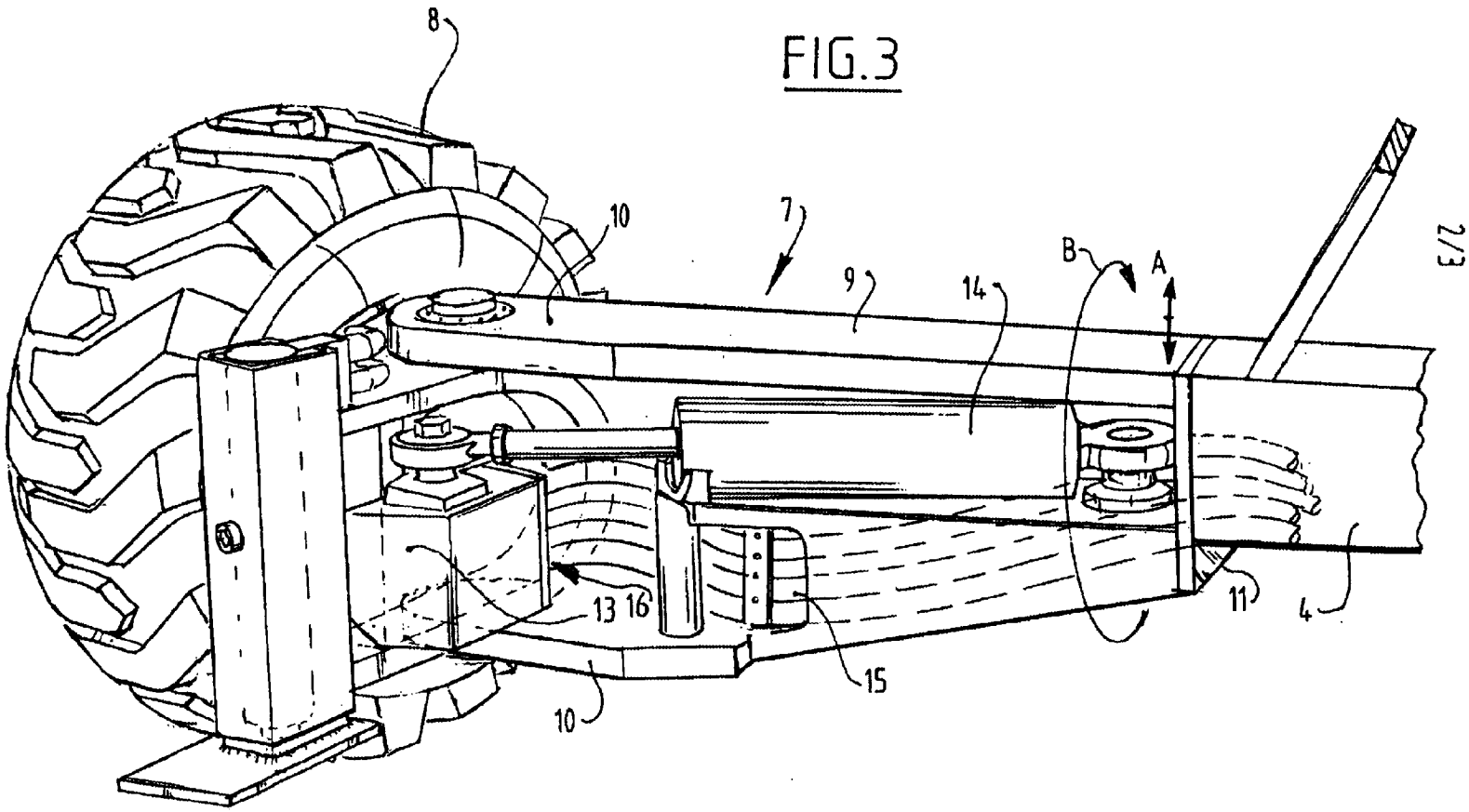
FIG. 3 shows a detail of the fork-lift truck of FIG. 1.

It is noted that in FIG. 3 the transition between arm 4 and fork 9 is discontinuous on the underside of the assembly. Such a discontinuity with possibly sharp edges can be dangerous to users and bystanders. FIG. 2 shows that a substantially triangular transitional part 12 can be used to even out such a discontinuity. In FIG. 2 the fork 9 is positioned higher relative to leg 4 in the direction of arrow A in FIG. 3 than the fork 9 shown in FIG. 3. Such a discontinuity on the top side should preferably be evened out with a transitional part 12. The expectation is that such a discontinuity on the underside is less hazardous, although such a transitional part can also be applied here.

Also shown clearly in FIG. 2 is that, compared to the situation of FIG. 3, fork 9 has been rotated a half-turn or the longitudinal direction thereof as according to arrow B. The leg 4 shown in FIG. 2 is therefore the leg other than the leg of frame 2 shown in FIG 3.

As already noted above, a fork is particularly favourable if a wheel block has to be arranged with for instance a motor 13 therein. In embodiments where no motors are used in the wheels on the legs, the wheel suspension 7 can also be designed other than as fork, for instance simply as extension of an arm 4 which can be arranged at different heights thereon.

It is noted that fork 9 as wheel suspension is also advantageous in concealing a cylinder 14 used as rotating mechanism to carry the wheels on legs 4 into different positions. In the positions shown in FIGS. 1 and 2 with full lines the fork-lift truck 1 is able to negotiate a bend in sideways direction. In the positions of wheels 8 shown in dotted lines the fork-lift truck 1 is suitable for forward travel. Cylinder 14 is used as rotating mechanism to enable varying of each of the wheels 8 between the positions shown with dotted lines and with full lines. Because cylinder 14 is concealed in the fork, it is practically insusceptible to damage and takes up no space other than the space already delimited by fork 9. This avoids the cylinder 14 having to be arranged on or laterally of legs 4. Cylinder 14 can be arranged in fork 9 because the space therein with the bending mechanism to be further described below does not have to be reserved for take-up of the slack in flexible power supply and control lines.

Figures 4A, 4B, 4C, 4D, 4E:
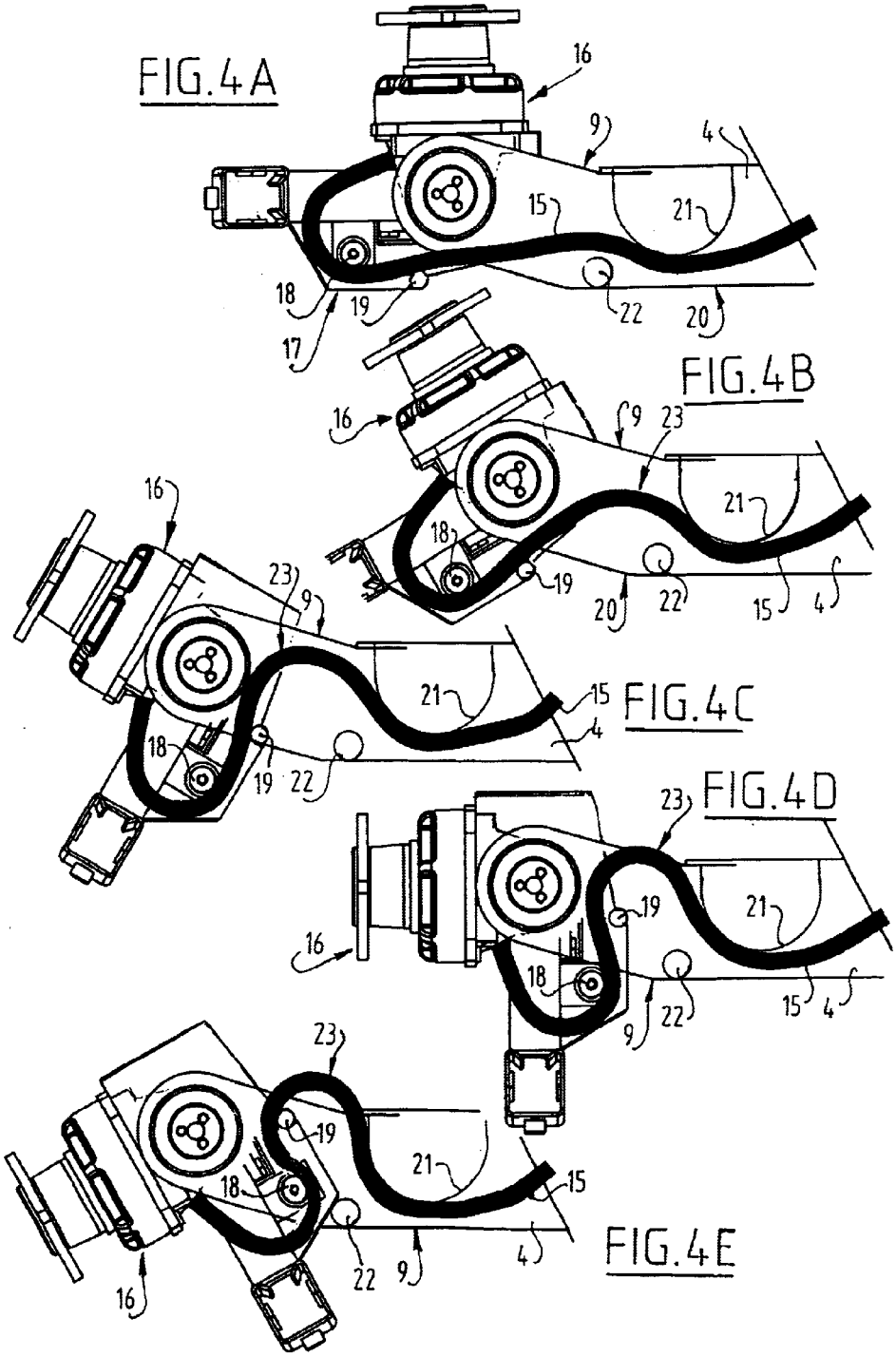
FIG. 4 shows five schematic views of a power supply and control line in different positions of the rotating mechanism of one of the legs under the influence of the action of the bending mechanism.

FIG. 4 shows a schematic view of a possible embodiment of a bending mechanism according to the present invention shown in different positions of the rotating mechanism. Shown by way of example in FIG. 4 is one of the power supply and control lines, a line 15 connected to motor 13. In FIG. 4A the cylinder 14 of FIG. 3 is in a far extended position thereof, wherein a wheel block 16 with motor 13 therein is oriented for travel straight ahead of the fork-lift truck. In the successive views of FIGS. 4A, 4B, 4C, 4D and 4E the cylinder 14 is retracted further in each case to rotate the position of wheel block 16. In the position shown in FIG. 4D, the fork-lift truck can travel sideways and in the position shown in FIG. 4E the fork-lift truck can even negotiate a bend sideways. During rotation of wheel block 16 there occurs slack in the lines 15. This is taken up with a bending mechanism.

The bending mechanism comprises a clamp 17 on wheel block 16. The clamp is formed by cams 18 and 19 between which line 15 is arranged. Cams 18, 19 are placed some distance from each other along the length of line 15 and thus define from the side of wheel block 16 a bend or curvature 23 in line 15 which, during the progression through the positions of wheel block 16 shown in the sequence of FIGS. 4A–4E, results in bending of line 15.

On the side of leg 4 is arranged a guide 26 which comprises a part-circular element 21 and a stop 22. Part-circular element 21 and stop 22 are also placed some distance from each other along the length of line 15 and thus define from the side of wheel block 16 a bend or curvature in line 15 which, during the progression through the positions of wheel block 16 shown in the sequence of FIGS. 4A–4E, results in bending of line 13. The line rolls over part-circular element 21 as it passes through said positions. Stop 22 prevents the line 15 being able to slide in leg 4 and thus ensures that line 15 does actually roll over part-circular element 21 as it progresses through said sequence.

It will be apparent that the bending or curvature 23 in line 15 is formed through the open side of fork 9 outside leg 4 and does not therefore have to be accommodated in the interior of leg 4.

Many other modifications and alternative embodiments will occur to the skilled person after examination of the foregoing. As noted, the form of the wheel suspensions is not limited to forks, but simply extensions of legs 4 may also be applied. Wheels 8 do not have to be driven with motors 13, but line 15 can also serve only to control the rotating mechanism. FIG. 3 shows a support foot which can be energized with a cylinder shown in phantom lines. By displacing the foot downward with the cylinder the relevant leg comes to rest thereon so as to obtain a more stable situation. The lines can also lead to this construction. The slack does not necessarily have to be carried outside the legs or forks designed as extension thereof. In an alternative embodiment to the described above, the slack can be taken up in the interior of the legs without sliding contact. The lines can then be stored meandering over a considerable part of the length of the legs without sliding along an inner wall of the legs. Rotatable guides can be applied for this purpose. A tensioning mechanism is also possible as bending mechanism, wherein forming of the bends in the lines takes place with tensioning force. Such a tensioning mechanism can be energized with the rotating mechanism, or the rotating mechanism can on the contrary be adapted to overcome a tensioning force exerted by the tensioning mechanism on the lines in order to pull them into an S-shape. The cams, the stop and the part-circular body can each be designed as running wheel.

It will be apparent that the invention is defined solely on the basis of the definition in accordance with the appended claims.

What is claimed is:

1. Fork-lift truck for selectively displacing a load forward or sideways, comprising:

a horizontal, substantially U-shaped frame;

a lifting mechanism for carrying the load, wherein legs of the frame extend along the lifting mechanism; and wheels on the legs which are connected to the legs via rotating mechanisms for driving and are rotatable on a substantially upward axis between positions corresponding with sideways and forward movements of the fork-lift truck, wherein flexible power supply and control lines run with slack through the legs to the wheels, and further comprising a bending mechanism at each of the legs for bending the power supply and control lines without frictional contact with the interior of the legs during release of the slack.

2. Fork-lift truck as claimed in claim 1, wherein the bending mechanism comprises at least one clamp which is connected to the rotating mechanism and which, when the rotating mechanism rotates, carries an associated flexible power supply and control line into a curve which, when moving in the direction of the leg, approaches the direction parallel to a tangent on a turning circle of the rotating mechanism.

3. Fork-lift truck as claimed in claim 1, wherein the bending mechanism comprises at least one guide connected to the leg which, when the rotating mechanism rotates, carries an associated flexible power supply and control line into a curve which, when moving in the direction of the leg, approaches the direction parallel to a tangent of a turning circle of the rotating mechanism.

4. Fork-lift truck as claimed in claim 3, wherein the guide comprises an element of part-circular cross-section.

5. Fork-lift truck as claimed in claim 4, wherein the guide further comprises a stop placed opposite the element relative to an associated power supply and control line.

6. Fork-lift truck as claimed in claim 4, wherein the stop is placed at a distance from the element along the associated power supply and control line.

7. Fork-lift truck as claimed in claim 1, wherein the bending mechanism defines an S-shape for bending of the power supply and control lines.

* * * * *